United States Patent [19]

Smith et al.

[11] 4,007,660

[45] Feb. 15, 1977

[54] ROCKET RETENTION AND IGNITION ASSEMBLY

[75] Inventors: Donald Leslie Smith, Ste. Foy; Donald William Noble, Ottawa, both of Canada

[73] Assignee: Her Majesty The Queen, Ottawa, Canada

[22] Filed: Mar. 1, 1976

[21] Appl. No.: 662,921

[30] Foreign Application Priority Data

Sept. 29, 1975 Canada ..... 236576

[52] U.S. Cl. ..... 89/1.807; 89/1.814

[51] Int. Cl.[2] ..... F41F 3/04

[58] Field of Search ..... 89/1.807, 1.814, 1.812, 89/1.806

[56] References Cited

UNITED STATES PATENTS

| | | | |
|---|---|---|---|
| 3,088,373 | 5/1963 | Robert et al. | 89/1.814 |
| 3,194,119 | 7/1965 | Robert et al. | 89/1.814 |
| 3,315,565 | 4/1967 | Nash | 89/1.807 |
| 3,396,628 | 8/1968 | Nash | 89/1.814 |
| 3,504,593 | 4/1970 | Ricks et al. | 89/1.807 |
| 3,753,382 | 8/1973 | Rusbach | 89/1.814 X |
| 3,754,497 | 8/1973 | Rusbach | 89/1.814 |

FOREIGN PATENTS OR APPLICATIONS

| | | | |
|---|---|---|---|
| 1,023,679 | 3/1966 | United Kingdom | 89/1.807 |
| 1,182,275 | 2/1970 | United Kingdom | 89/1.806 |

*Primary Examiner*—David H. Brown

[57] ABSTRACT

A rocket retention assembly for use with a rocket launcher and rockets provided with outwardly extending shear rings at their rear ends. Each rocket is provided with a conducting ring extending about the periphery of its rear end. The assembly includes a first support plate for engaging the shear ring when the rocket is placed in the firing position in the rocket launcher and preventing forward displacement of the ring from the firing position. This support plate has a loading hole for each launch tube formed therein. A second support plate engages the shear ring when the rocket is in the firing position and prevents rearward displacement of the shear ring from the firing position. This second support plate has an opening formed therein for each launch tube of the rocket launcher, each opening being located at the rear end of a rocket in a launch tube. An electrical conducting finger for each launch tube is attached to the second support plate and is connected to an electrical plug, also attached to the second support plate. For each electrical plug, there is a corresponding electrical socket attached to the first support plate. By simply placing the rockets in their respective launch tubes and orienting the second support plate with respect to the first support plate in such manner that the electrical plugs are electrically connected to their respective electrical sockets when the second support plate engages the shear rings, the conducting fingers are automatically placed in contact with the conducting rings of the rockets.

10 Claims, 6 Drawing Figures

ROCKET RETENTION AND IGNITION ASSEMBLY

BACKGROUND OF THE INVENTION

This application relates to rocket launchers and more particularly to an improved means for retaining and igniting rockets within a launcher tube.

A number of prior retention systems make use of detent or latch mechanisms which protrude into the launcher tube through holes in the side of the tube wall to engage the rocket and hold it in position. Such systems are unsatisfactory in that the necessary holes or slots in the launch tube walls become eroded by the rocket exhaust. Moreover such detents or latch mechanisms protruding into the launch tube interfere with the reproducibility of the rocket release loads.

Certain more recent systems have eliminated the aforementioned disadvantages of detents or latch mechanisms by securing the rocket in position in the launch tube by means of a shear pin engaged in a shear pin ring which is mechanically secured to the rocket launcher at the base of the rocket launcher tube so that the shearing force of the shear pin or shear pins determine the rocket release load. Such systems, however, have introduced the additional disadvantage of necessitating individual correct orientation of the rockets and/or electrical connections between the rockets and the launcher, thus increasing both the loading time and the incidence of non-functioning or mal-functioning of the rocket ignition systems.

Accordingly it is an object of the present invention to provide a simple positive means for securing rockets in a loaded position ready for firing and for igniting the rockets which does not require any particular orientation of the rockets within the launching tubes or of any of the individual electrical connections for the rocket ignition system.

With the rocket retention and ignition assembly of the present invention the rockets are simply loaded into the rear end of each tube of the rocket launcher through a loading hole for each tube which permits passage of the rocket therethrough but which is too small to permit passage of a retention member, such as a shear pin ring, attached to the rear end of each rocket. First support means such as a rigid plate or bulkhead forming this loading hole thus engage the shear pin ring of each rocket and prevent any forward displacement of the rocket in its respective launch tube. A second support means such as a rigid plate is then connected to the rear of the rocket launcher to prevent rearward displacement of the rockets in their respective tubes. This second support means has an opening formed therein for each rocket to be secured, each opening being located at the rear end of a rocket thus allowing for the exit of rocket exhaust for as long as the rocket remains in the launch tube after ignition.

Each rocket has a first electrical contact at its rear end, preferably in the form of a contact ring extending about the periphery of the rear surface of the rocket. A second electrical contact is located adjacent each opening formed in the second support means and preferably is electrically connected to an electrical plug rigidly attached to the second support means. A cooperating electrical socket is attached to the support means beside each launcher tube. By simply placing each rocket in the firing position and orienting the second support means with respect to the first support means so that the electrical plugs and sockets are electrically connected to each other when the second support means is connected to the rear of the rocket launcher, contact is automatically made between the first and second electrical contacts. This results in a suitable electrical circuit being formed for firing the rocket.

Another object of the rocket retention and ignition assembly of the present invention is to avoid any need for loose plugs or wires such as those employed in some previous retention systems and any need for any separate "plugging" operation once the second support means has been connected in place. Such a separate plugging step might very well use up valuable time which could be better spent on other operations. The present system is strong and has great wear resistance, one reason being the lack of small, loose, or dangling parts which might easily be broken or lost. It will be appreciated that the wires of some previous systems can break, thus necessitating repairs which consume further valuable time or resulting in plugs being lost altogether.

A further object of the present retention and ignition assembly is to avoid the need for holes or slots in the walls of the launch tubes so that tube failure due to erosion is less likely or is at least delayed in comparison with the time before failure in tubes having holes or slots. The present invention also permits the use of known shear pin rings which are advantageous in that, because they remain in the tubes when the rockets are fired, they help to protect the surrounding first and second support means from the rocket exhaust and, as mentioned, they permit rocket release conditions to be accurately preset with the shear pins.

SUMMARY OF THE INVENTION

Accordingly the rocket retention and ignition assembly of the present invention is for use in combination with a rocket launcher and a rocket with a retention member outwardly extending from the side of the rear end of the rocket wherein the retention member disconnects from the remainder from the rocket when the rocket is fired. The rocket has a first electrical contact on its rear surface, preferably extending about the periphery of the rear surface. The assembly of the present invention includes first support means for engaging the retention member when the rocket is placed in the firing position and preventing forward displacement of the retention member from the firing position. This first support means has a hole formed therein to permit loading of the rocket therethrough into the rocket launcher, this hole being too small to permit passage of the retention member therethrough. Second support means are provided to engage the retention member when the rocket is in the firing position and prevent rearward displacement of the retention member. This second support means has an opening formed therein which is located at the rear end of the rocket when the second support means engages the retention member. A second electrical contact attached to the second support means and electrical connection means having two parts are provided. One of these parts is attached to the second support means and is electrically connected to the second contact. The other of these parts is attached to the first support means. By simply placing the rocket in the firing position and orienting the second support means with respect to the first support means in such manner that the two parts are electrically connected to each other when the second support means engages the retention member, the second contact contacts the first contact and an electrical circuit is thereby formed for firing the rocket.

Preferably the first electrical contact is arranged to contact the second electrical contact whatever the orientation of the rocket in the firing position and the second contact is a conducting finger contacting the ring of the first contact by way of the opening.

Other advantages and features of the present invention will become apparent from the following detailed description of a preferred embodiment and the accompanying drawings.

DETAILED DESCRIPTION OF PREFERRED EMBODIMENT

Figure 1:
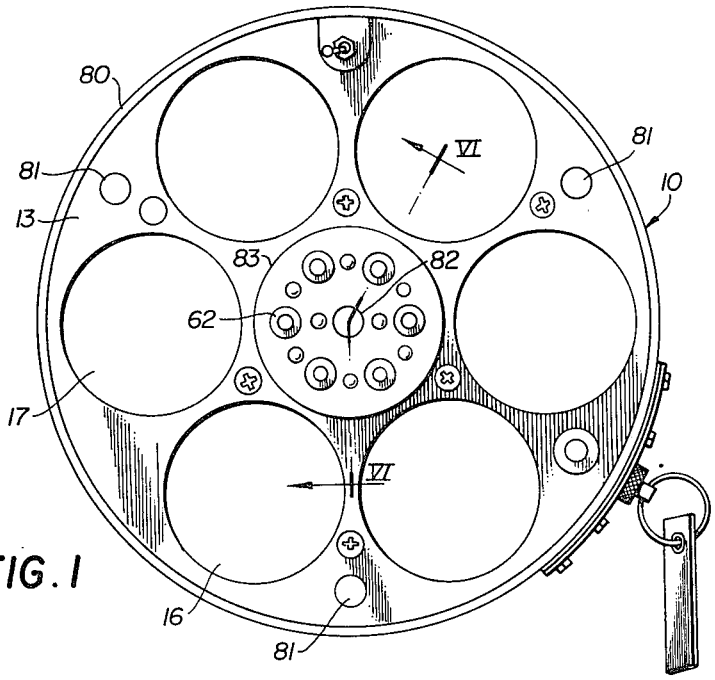
FIG. 1 is a rear view of an empty multi-tube rocket launcher with the second support means removed.

In the drawings, FIG. 1 is a rear view of a multi-tube rocket launcher 10 which can be mounted on a suitable support (not shown) for firing rockets placed therein. The launcher shown in the drawings has six launch tubes 16 but the present invention can be used with larger launchers as well, such as a nineteen tube launcher.

The six launch tubes 16 are enclosed in a tubular shell or skin 80 whose rear end is covered by a first support means 13. The skin 80 forms an annular flange projecting a short distance rearwardly of the support means 13. The support means preferably comprises a circular support plate which can be made of strong, wear resistant material such as steel and which is semi-permanently attached to the support assembly for the tubes 16. If necessary, the support means 13 can be removed from the rocket launcher to permit repairs on internal components such as electrical wire. Three holes 81 are formed about the periphery of the support means 13. Similarly, a hole 82 is formed in the center of the support means, this hole extending through a smaller circular plate 83 located at the center of the support means 13. Each of the holes 81 and 82 has thread means associated therewith in order to engage a bolt inserted through the respective hole. This thread means can be provided by a captive nut attached to the front surface of the plate forming support means 13. Each nut, whose center axis corresponds to the center axis of its respective hole 81 or 82, can for example be welded or glued to the support means.

The smaller plate 83, which is rigidly attached to the support means 13 such as by means of rivets, accommodates six electrical jacks or sockets 62 distributed in a circular pattern about the center hole 82. Each of these jacks is constructed in a well known manner to accommodate a single prong plug described in detail hereinafter. Further description of these electrical jacks is deemed to be unnecessary as it would be obvious to one skilled in the electrical art.

Figure 2:
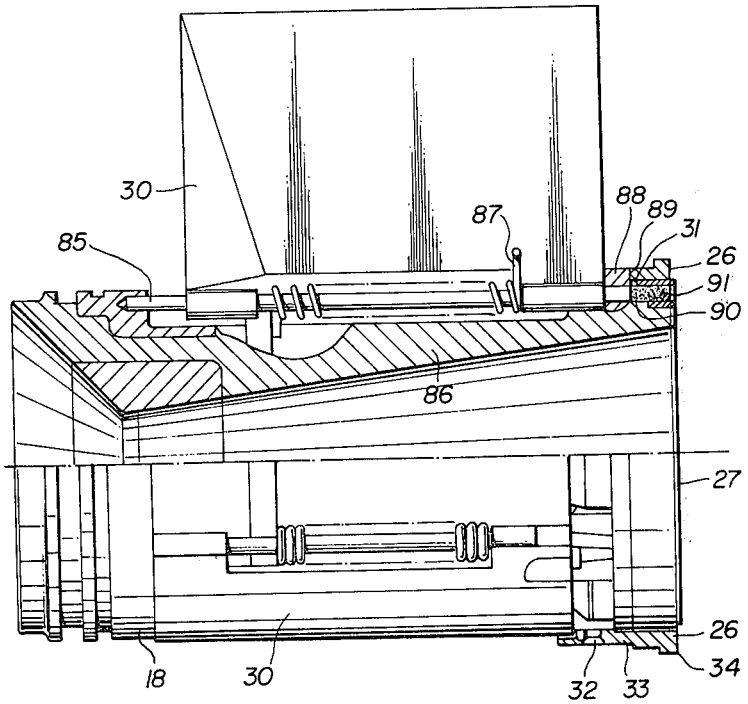
FIG. 2 is a side view, partly in section, of the nozzle and fin assembly at the rear of a rocket suitable for use in a rocket launcher constructed according to the present invention.
Figure 3:
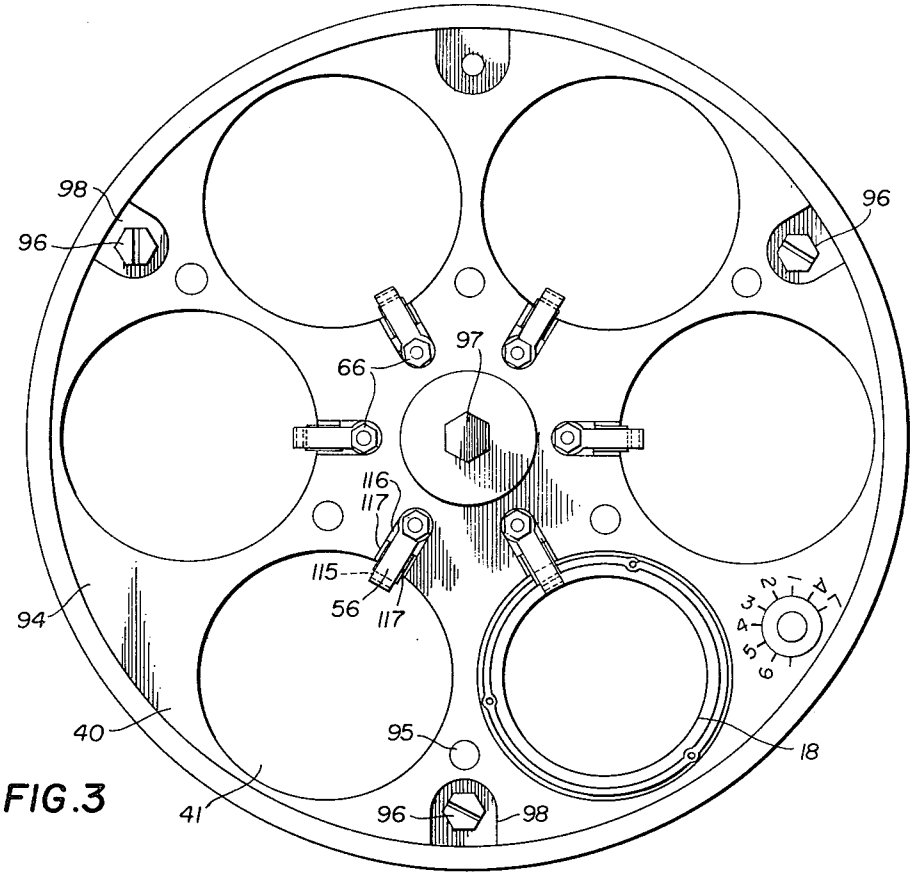
FIG. 3 is a rear view of the rocket launcher of FIG. 1 with the second support means in place and having one launch tube with a rocket in the firing position located therein.

As stated, six launch tubes 16 project from the front of the support means 13, the rear ends of their hollow interiors being placed over suitable holes 17 formed in the support means 13. Each of the tubes 16 is long enough to enclose and support a suitable rocket 18 loaded therein. The rear end of one of these rockets is shown in FIGS. 2 and 3. Each hole 17 is formed with a diameter such that the interior surface of each launch tube forms a relatively smooth joint with the cylindrical surface of the plate defining the hole 17.

The rocket 18 is of generally conventional construction and therefore need not be described in detail except for the retention member 26 and the electrical contact 27 which will be described hereinafter. The rocket 18 can be of the solid propellant type with the power means located immediately in front of the fin and nozzle assembly shown in FIG. 2 and the war head located at the front end. The bourrelet 31 forms part of the fin and nozzle assembly and helps support the rear end of the rocket in the launch tube. Each rocket shown is fitted with three fins 30, each of which is pivotally mounted on a support pin 85. Each fin, which rests against the exterior surface of the nozzle 86 when positioned in the launch tube, is biased to swing outwardly to the position shown at the top of FIG. 2 by means of a coil spring 87. It will be understood that each fin forms a circular arc in cross section extending through approximately 120°. The retention member 26 is connected to the rear of the fin and nozzle assembly by means of one or more shear pins 32. As can be seen from FIG. 2, the retention member 26 extends outwardly from the side of the rear end of the rocket and preferably comprises a shear ring extending about the periphery of the rear end. Three short lugs 33 extend from the shear ring towards the front end of the rocket, each lug being spaced approximately 120° from the other lugs relative to the center axis of the shear ring. Each lug of course has its own shear pin 32 which is accommodated in a hole formed in the lug. Each pin 32 extends into a hole formed in the side of nozzle 86. A lug detent ring 88 extends about the exterior surface of the nozzle 86 and is used to support the support pins 85 of the fins. This ring 88 has three recesses formed about its exterior to accommodate the three lugs 33 of the shear ring. The front end 89 of the shear ring 26 rests against the rear surface of the detent ring. An open electrical circuit is formed between the lug detent ring 88 and the electrical contact 27 which is preferably in the form of a ring extending about the rear end of the nozzle 86. The pin hole 90, which extends through the detent ring 88 and bourrelet 31, is filled with an epoxy resin such as bakelite. This epoxy resin 91 extends from the end of the support pin 85 to almost the rear surface of the nozzle. There is a small gap between the rear end of the epoxy resin and this rear surface as indicated in FIG. 2.

A radially outwardly extending annular flange 34 formed on the shear ring 26 has an external diameter which does not permit passage of this flange through the holes 17 formed in the support means 13. In other words, in the firing position of the rocket, the edge of each hole 17 engages the front surface of the flange 34 so the rocket is effectively prevented from moving further forward in the launch tube. As stated, the use of such a shear ring and shear pins is known in this art. The shear ring disconnects from the remainder of the rocket when the rocket is fired by means of the shearing of the shear pins. The force required to shear the shear pins can be accurately predetermined and therefore rocket release conditions can be accurately preset with the use of such shear pins and are therefore reproducible.

Second support means 40 is attached to the rear of the first support means 13 in order to complete the support means for the rockets 18 in the launch tubes. The second support means engages the retention members 26 of the rockets when they are in their firing positions and thereby prevents rearward displacement of the retention members from the firing position. As clearly shown in FIG. 4, the second support means preferably consists of front and rear plate members 93 and 94 respectively, these plate members being rigidly connected together by six rivets 95 or other suitable fastening means. Each of these plate members 93 and 94 is substantially circular and has six openings 41 formed therein. Each of these identical openings is circular and each opening in each plate is coaxial with an opening in the other plate member. Also, each opening 41 is arranged so as to be located at the rear end of a rocket 18 when the second support means is connected to the first support means. Each opening 41 has a diameter smaller than the external diameter of the flange 34 of the retention member. In the illustrated embodiment, the diameter of each opening is equal to the internal diameter of the shear ring. Thus the rear surface of the annular flange 34 is engaged by the forward-facing surface of the edge of the second support means 40 forming the opening 41. In this manner, rearward movement of the rocket in the launch tube due to vibrations or other movements of the rocket and launch tube is prevented and the rocket is held firmly in position.

Figure 5:
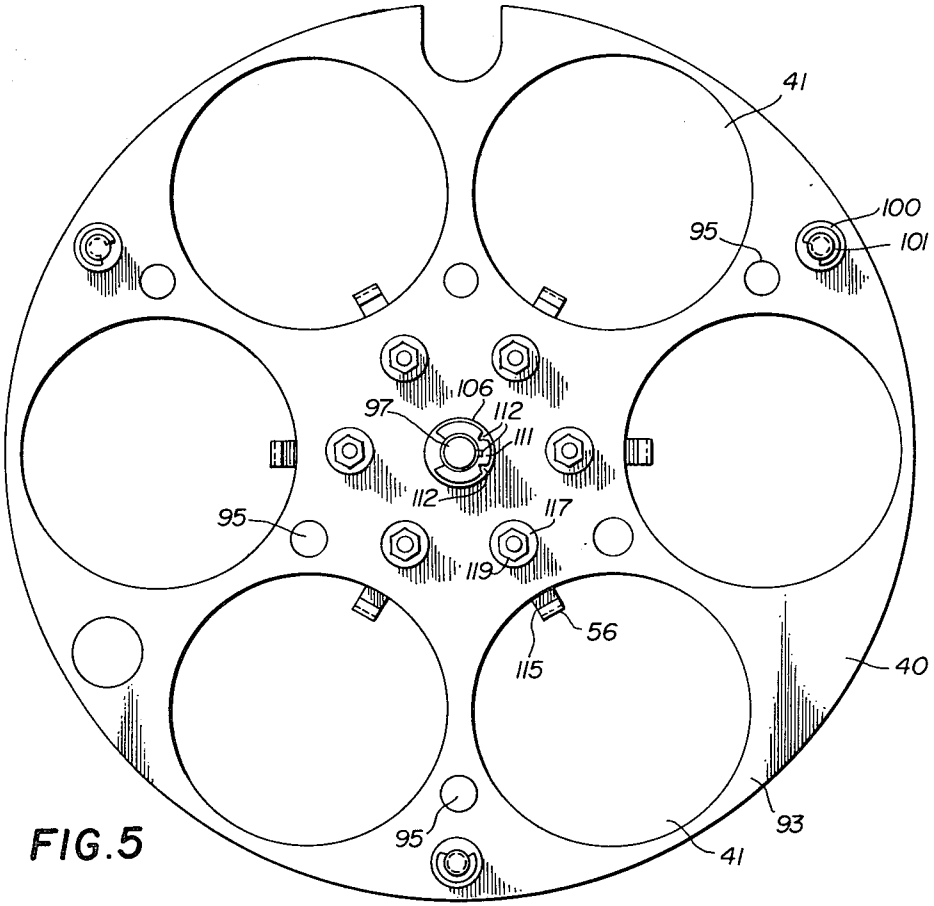
FIG. 5 is a front view of the second support means shown in FIG. 4.

FIG. 3 of the drawings shows the rear of the multi-tube rocket launcher with the second support means 40 connected thereto by means of three outer bolts 96 and a center bolt 97. U-shaped recesses 98 are formed about the periphery of the rear plate member 94 to accommodate the heads of the bolts 96. A hole 99 is formed in the front plate member 93 to permit passage of each bolt 96 therethrough. A spacer collar 100 and washer 101 are also preferably placed over the threaded end of each bolt 96 in order that the second support means 40, when securely fastened to the rear of the rocket launcher, will be arranged an equal distance from the first support means 13 at all locations. As shown in FIG. 5, each of the washers 101 is C-shaped and acts to prevent the spacer collar 100 from coming off of the bolt 96. It should be noted that the threaded portion 102 of each bolt has an external diameter greater than the remaining portion 103 of the bolt. Thus the threads prevent the washer 101 from slipping off of the threaded end of the bolt. In this manner the bolts 96 are effectively attached to the second support means 40 at all times, even when this support means has been disconnected from the rocket launcher.

Similarly, the center bolt or retention screw 97 is attached to the support means 40 at all times although it is free to turn in a hole 104 formed in the center of the support means 40. A relatively large flat washer 105 is placed between the head of center bolt 97 and the rear plate member 94. Located between the washer 105 and member 94 is a fluorocarbon (TEFLON (a trade mark)) washer **104*a* to reduce friction between these members. A smaller retention washer 106 is placed on the center bolt after insertion of the bolt through the support means 40. This washer is accommodated in an annular recess 110 formed between the bolt 97 and the front plate member 93. This recess is formed due to the fact that the diameter of the hole 104 is larger through the plate member 93 than it is through plate member 94. The retention washer 106 is held firmly in the recess 110 by a retaining ring 111 of generally C-shape. As can be seen from FIG. 5, the ring 111 has at least three notches 112 formed therein so that the ring can expand sufficiently to grasp the center bolt 97. An annular recess is preferably formed around the bolt 97 approximately midway along its length and the inner edge of the ring 111 fits into this recess. Approximately one half of the length of bolt 97 is threaded at 113. Located between the washer 106 and the member 94 is another fluorocarbon washer 106*a*** which reduces friction between these two members.

The electrical contact 27 (also herein called the first electrical contact) is arranged so that no matter what the orientation of the rocket 18 in the launch tube may be, the contact 27 will always be in electrical contact with a second electrical contact 56 which is attached to the second support means 40. It should be noted that the contact ring 27 is electrically insulated from the rest of the nozzle structure. The second electrical contact 56 is preferably in the form of a conducting finger which contacts the first conduit 27 by way of the adjacent opening 41. This conducting finger extends along the rear surface of rear plate member 94 and then extends a short distance across the rear of the opening 41. That portion which extends into the opening 41 is preferably bent inwardly to form a U-shape. The short leg 115 of the contact 56 lies generally in the plane of the front surface of the support means 40. If desired, the conducting finger or contact 56 can be spring loaded so that it will always form a good contact with the contact 27 on the rocket.

Figure 4:
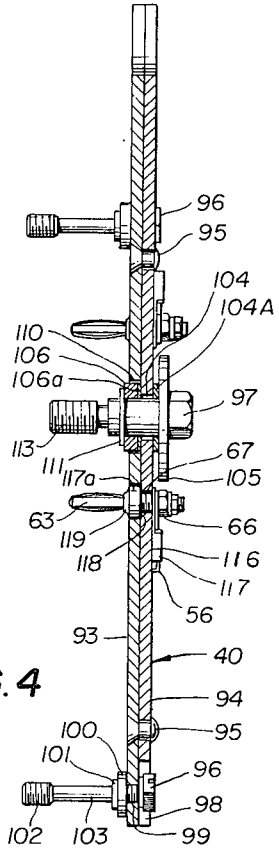
FIG. 4 is a side view of the second support means.

An electrical plug 63 is electrically connected to the second electrical contact 56 by means of a nut 66. The plug 63 extends through the second support means 40 and has a rearwardly-projecting portion which is threaded to receive the nut 66. If desired, the conducting finger 56 can be formed with a hole at one end through which the rearwardly-projecting portion of the plug 63 is inserted. An insulator support 116 is inserted between finger 56 and rear plate member 94 so that finger 56 is completely electrically insulated from the support means 40. Two parallel ridges 117 are preferably formed along opposite side edges of the insulator support. The finger or contact 56 fits snuggly between the two ridges and is thereby prevented from slipping off of the support 116 into contact with the support means 40. In the opening **117*a* which extends through the support means 40 to accommodate each plug 63, a shoulder 118 is formed The relatively large diameter center portion 119 of the plug 63 rests against this shoulder 118 to prevent the plug slipping rearwardly through the hole 117*a*. An insulating collar 67 extends about the center of each plug 63 to electrically insulate the plug from the surrounding support means 40. This collar has a narrow portion extending through the rear plate member 94 and a wider portion to accommodate the center portion 119 of plug 63. The preferred form of electrical plug 63 is shown in FIG. 4** and it is a well known "banana" electrical plug.

Figure 6:
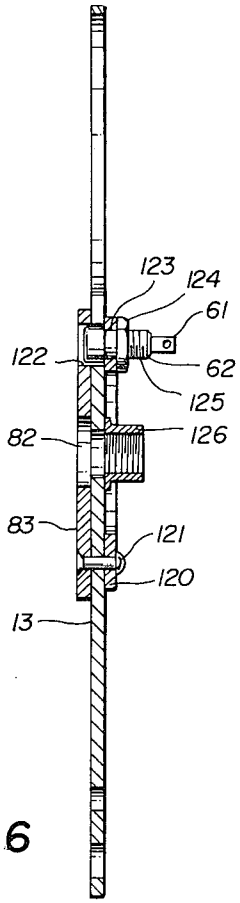
FIG. 6 is a sectional view taken along line VI—VI of FIG. 1 showing the centre portion of the first support means.

The electrical jack or socket 62 into which each plug 63 is inserted is shown in detail in FIG. 6. The plug 62 shown is an insulated banana jack rigidly mounted in a plug ring 120. The spacer plate 83 on the rear surface of support means 13 and the plug ring 120 are rigidly connected to the first support means 13 by means of rivets 121. A hole 122 accommodates the rear end of each electrical jack 62 and extends through the plate 83 and the plate forming support means 13. A smaller diameter hole 123 is formed in the plug ring 120 for each of the jacks 62. A hexagonal nut is glued in place with a suitable cement over each of the holes 123 so that the hole in the nut is coaxial with the corresponding hole 123. This nut 124, only one of which is shown in FIG. 6, provides means for securely fastening the jack or socket 62 to the first support means 13 as the threads 125 in the center region of the jack engage the threads of the nut. Means are provided on the front end of the plug 62 to connect an electrical wire to the plug. It will be clearly understood that insulating means are also provided for insulating the inside of banana jack 62 from the surrounding support means 13, the nut 124, and the plug ring 120.

The first and second electrical contacts 27 and 56 from part of an electrical circuit which is used to fire or ignite the propellant in the rocket. Part of this electrical circuit is formed by the fins of the rocket 18, the metal launch tubes 16, and the launcher structure. This portion of the circuit is known in the art and need not be described in further detail. This is the ground or common side of the igniter circuit for the rocket that is electrically connected to the retention member 26 or shear pin ring. The other side or live side of this igniter circuit is connected by a wire (not shown) to a stepping switch (not shown) which determines the sequence in which the six rockets are fired. The use and arrangement for such a switch is well known in the art and is deemed not to require further description herein. An electrical switch to fire the rockets and suitable power means are also provided. An insulated electrical wire extends from the stepping switch to one part of electrical connection means, this one part being formed by the socket 62. The other part of the electrical connection means is of course formed by the banana type electrical plug 63.

Each electrical plug 63 and its respective electrical socket 62 are connected together during the attachment of the support means 40 to the rear of the rocket launcher. After all of the rockets 18 have been loaded into their respective launch tubes 16, the second support means 40 is placed up against the rear end of the rocket launcher and the holes therein are rotated until they are arranged over the rear ends of the rockets. At this time, the six electrical plugs 63 should also be in alignment with the electrical sockets 62 in the rear of the rocket launcher. At this time, the center bolt 97 extends into the hole 82 formed in the center of the first support means 13. As can be seen from FIG. 6, an internally threaded nut 126 is rigidly connected to the front surface of support means 13 so that its center axis is coaxial with the center axis of hole 82. Once the support means 40 has been properly aligned, the center bolt 97 is given one or two turns, by hand, just sufficient to engage the threads of the bolt 97 with the threads of the nut 126. The initial attachment operation causes the electrical plugs 63 to butt against the entrance of their respective jacks or sockets 62. The center bolt 97 is then tightened down completely with a ratchet or speed handle socket wrench. This further tightening causes the six electrical plugs to be firmly inserted into their respective jacks and fits the second support means 40 tightly in place over the first support means 13 and the retention members 25. The outer bolts 96 are then tightened with the same tool used to tighten the center bolt 97. This tightening operation serves to further lock the second support means 40 in place and prevents it from being dislodged or buckled by the rocket exhaust.

It will be understood that when the second support means 40 has been attached in this manner, the electrical contacts or fingers 56 are placed in engagement with the corresponding electrical contacts 27 so as to form the necessary electrical circuits to fire all of the rockets 18. When the rockets are ignited by applying electrical power from the firing circuit through each electrical jack 62 and its corresponding plug 63 to the contacts rings 27 of the rockets, the rockets are ignited and the thrust in each rocket builds up to a predetermined level. At this level, the shear pins 32 of the rocket retention member are sheared and the rocket is released from the launch tube. Thus each retention member 26 is left in the rocket launcher, clamped between the first and second support means. The shear pin ring or retention member serves to protect the support means 13 and 40 from the erosive blast of the rocket exhaust as the rockets leaves the launch tube.

In order to remove the left-behind retention members 26 or unfired rockets, the above described procedure is reversed. The outer bolts 96 are first unscrewed from the first support means 13. Then the center bolt is unscrewed. Because the center bolt 97 is connected to the support means 40 in the manner described above and as shown in FIG. 4, the unscrewing of the bolt 97 causes the electrical plugs 63 to be pulled evenly from their socket 62. In this way, damage to these plugs is prevented and the plugs will not jam in their sockets during the detachment of the support means 40. Once the support means 40 has been removed from the launcher, the shear pin rings or unfired rockets can then be simply pulled from their launch tubes.

It should be noted that the openings 41 have a diameter which is slightly greater than the external diameter of each ring forming an electrical contact 27. This prevents electrical contact between the support means 40 and the contact 27.

It will be readily recognized from the foregoing description that the rocket retention assembly of the present invention does indeed provide a means for quickly loading and electrically connecting a rocket launcher in a manner which will prevent rocket firing failures and which will increase the life of the rocket launcher parts.

What we claim as our invention is:

1. A rocket retention and ignition assembly for a rocket launcher and for a rocket with a retention member outwardly extending from the side of the rear end of said rocket, said retention member disconnecting from the remainder of said rocket when said rocket is fired, and a first electrical contact on said rear end, said assembly comprising first support means for engaging said retention member when said rocket is placed in a firing position in said rocket launcher and preventing forward displacement of said retention member from the firing position, said first support means having a loading hole formed therein to permit loading of said rocket therethrough into said rocket launcher, said hole being too small to permit passage of said retention member therethrough, second support means for engaging said retention member when said rocket is in said firing position and preventing rearward displacement of said retention member from the firing position, said second support means having an opening formed therein, said opening being located at said rear end when said second support means engages said retention member, a second electrical contact attached to said second support means, and electrical connection means having two parts, one of said two parts being attached to said second support means and electrically connected to said second contact, the other of said two parts being attached to said first support means, wherein by simply placing said rocket in said firing position and orienting said second support means with respect to said first support means in such manner that said two parts are electrically connected to each other when said second support means engages said retention member, said second contact contacts said first contact and an electrical circuit is thereby formed for firing said rocket.

2. A rocket retention and ignition assembly according to claim 1, wherein said second support means is a plate member which is rigidly connected to said first support means in order to prevent rearward displacement of said retention member and which is disconnectable therefrom to permit loading of said rocket.

3. A rocket retention and ignition assembly according to claim 1, wherein said one of said two parts is an electrical plug and said other of said two parts is an electrical socket and said two parts are electrically connected by connecting said second support means to said first support means after said rocket has been placed in said rocket launcher.

4. A rocket retention and ignition assembly according to claim 1, wherein said retention member of said rocket is a ring extending about the periphery of said rear end and connected to the remainder of said rocket by shear pin means, said loading hole is round, said first support means is a plate member forming a circular edge extending about the sides of said loading hole, and said edge engages a front surface of said ring to prevent forward displacement of said retention member.

5. A rocket retention and ignition assembly according to claim 1, wherein said second support means is a plate member having a number of openings formed therein and capable of engaging the retention members of a number of rockets and preventing rearward displacement of the retention members from the firing position and wherein said second support means has a number of second electrical contacts attached thereto.

6. A rocket retention and ignition assembly according to claim 1 in combination with said rocket, wherein said first electrical contact on said rocket extends about the periphery of said rear end and contacts said second electrical contact whatever the orientation of said rocket in said firing position.

7. A rocket retention and ignition assembly according to claim 6 wherein said second contact is a conducting finger which contacts said first contact by way of said opening.

8. A rocket retention and ignition assembly according to claim 7 wherein said conducting finger extends along the rear surface of a plate member forming said second support means from said one of said two parts to said opening and a short distance across the rear of said opening and said one of said two parts is spaced outwardly from the adjacent side of the rear end of said rocket.

9. A rocket retention and ignition assembly according to claim 8 wherein said one of said two parts is an electrical plug insulated from said plate member and extending therethrough and said other of said two parts is an electrical socket insulated from said first support means.

10. A rocket retention and ignition assembly according to claim 8 wherein said second support means is a plate member having a number of openings formed therein and capable of engaging the retention members of a number of rockets and preventing rearward displacement of said retention members from the firing position and wherein said second support means has a number of second electrical contacts attached thereto.

* * * * *